US006754458B2

(12) United States Patent
Makihira

(10) Patent No.: US 6,754,458 B2
(45) Date of Patent: Jun. 22, 2004

(54) IMAGE FORMING APPARATUS WITH FIXING UNIT HAVING A SHUTTER FOR COVERING SAME

(75) Inventor: Tomoyuki Makihira, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 10/127,446

(22) Filed: Apr. 23, 2002

(65) Prior Publication Data

US 2002/0186986 A1 Dec. 12, 2002

(30) Foreign Application Priority Data

Apr. 25, 2001 (JP) ..... 2001-127263

(51) Int. Cl.[7] ..... G03G 15/20
(52) U.S. Cl. ..... 399/92; 399/122
(58) Field of Search ..... 399/92, 94, 320, 399/122, 98, 99, 71, 343, 357

(56) References Cited

U.S. PATENT DOCUMENTS 4,652,110 A * 3/1987 Sato et al. ..... 399/406
5,291,256 A * 3/1994 Kitajima et al. ..... 399/122

FOREIGN PATENT DOCUMENTS

| | | |
|---|---|---|
| JP | 05-333614 | 12/1993 |
| JP | 10-240104 | * 9/1998 |
| JP | 2002-323822 | * 11/2002 |

* cited by examiner

*Primary Examiner*—Quana Grainger
(74) *Attorney, Agent, or Firm*—Fitzpatrick, Cella, Harper & Scinto

(57) ABSTRACT

The image forming apparatus has fixing device for heat-fixing an unfixed image on a recording material, a shutter movable to a first position for covering the fixing device and a second position retracting from the first position, and an opening and closing member that is openable and closable with respect to an image forming apparatus main body.

In the image forming apparatus, the shutter has a plurality of holes, the shutter exists at the first position when the opening and closing member is open, the shutter exists at the second position when the opening and closing member is closed, and a size of the hole on the opening and closing member side of the shutter is smaller than a size of the hole on an opposite side of the opening and closing member.

14 Claims, 8 Drawing Sheets

IMAGE FORMING APPARATUS WITH FIXING UNIT HAVING A SHUTTER FOR COVERING SAME

BACKGROUND OF THE INVENTION

1. Field of the Invention

The present invention relates to an image forming apparatus such as a copying machine and a printer and, in particular, to a shutter provided in a fixing device that is applied to the image forming apparatus.

2. Related Art

FIG. 11 shows a schematic sectional view of an image forming apparatus provided with a conventional fixing device. In the figure, reference numeral 101 denotes a scanner unit having optical means for irradiating a laser beam, which is emitted according to image information, and scanning means for scanning by the laser beam and 110 denotes a process cartridge incorporating main image forming means. A photosensitive drum 103 functioning as an image bearing member, a roller charger 104 made of semiconductive rubber, a developing device 105 for carrying toner 106 onto the photosensitive drum 103 to develop an electrostatic latent image thereon and a cleaner 108 for removing waste toner from the photosensitive drum 103 are integrally incorporated in and constitute the process cartridge 110.

With the above-mentioned configuration, the photosensitive drum 103 in the process cartridge 110 is driven to rotate and the surface of the photosensitive drum 103 is uniformly charged by the roller charger 104. Subsequently, a laser beam emitted by the scanner unit 101 is irradiated on the photosensitive drum 103 via a mirror 102, whereby an electrostatic latent image is formed on the surface of the photosensitive drum 103. Then, toner is supplied to the surface of the photosensitive drum 103 to visualize the electrostatic latent image as a toner image by the developing device 105.

On the other hand, transferring materials (basis weight 64 to 216 g) 112 in a sheet feeding cassette 111 are separated piece by piece and supplied by a sheet feeding roller 113. The supplied transferring material 112 is conveyed to a pair of registration rollers 115 along upper and lower guides 114. The registration rollers 115 do not move until the transferring material 112 is supplied to them. When the transferring material 112 is supplied, its leading edge collides with the registration rollers 115, whereby skew feeding of the transferring material 112 is corrected.

Subsequently, the registration rollers 115 convey the transferring material 112 to a transferring portion in such a manner as to synchronize the end of the toner image formed on the photosensitive drum 103 with the leading edge of the transferring material 112. Further, a not-shown sheet feeding sensor is disposed in the vicinity of the registration rollers 115. The sheet feeding sensor senses a sheet passing state or jam and the length of the transferring material 112.

The transferring material 112 conveyed to the transferring portion as described above is applied a charge having a polarity opposite that of the toner by the transfer roller 107 from its back. As a result, the toner image formed on the photosensitive drum 103 is transferred to the transferring material 112. The transferring material 112 with the toner image transferred thereon is conveyed to a fixing device 118 by a conveying roller 117 and a conveying guide 116. The fixing device 118 fixes an unfixed toner image on the transferring material 112 by heat and pressure to form a recorded image thereon. Then, after the image is fixed, a conveying route is selected by a flapper 119 for the transferring material 112, which is discharged to a discharge tray 120 or 121.

Next, the fixing device 118 will be described.

The fixing device 118 is provided with a fixing roller 127 as a fixing body, a pressurizing roller 128 as a pressurizing body and a fixing inlet guide 130.

The fixing device 118 employs a central reference for conveying the transferring material 112, which has a width of A3 sheet (297 mm) as a maximum sheet passing size, with a sheet passing center of the device as a reference. The fixing device 118 of this type opens a fixing inlet shutter 123' as shown by solid lines to secure a conveying path when a transferring material is conveyed. In addition, when a transferring material is not conveyed, the fixing device 118 closes the fixing inlet shutter 123 as shown by broken lines to protect a user at the time of jam treatment.

However, in the conventional fixing device 118 provided with the fixing inlet shutter 123, since an air path cannot be secured around the fixing device 118 when a transferring material is conveyed, there is no air path in the vicinity of its inlet as shown by arrows indicating a flow of air in FIG. 11. As a result, temperature in the image forming apparatus increases to cause various harmful effects. In addition, a member of a complicated structure is required to secure an air path in an apparatus main body and, at the same time, retain heat of the fixing device 118 and protect a user at the time of jam treatment and the like, which causes increase of costs.

As means for coping with this problem, Japanese Patent Application Laid-Open No. 5-333614 describes securing of an air path by providing holes in a shutter.

Incidentally, in an image forming apparatus of this type, if an opening and closing member is provided in an apparatus main body, a part of the apparatus on the opening and closing member side tends to be exposed to the open air. Thus, for example, temperature further falls in a part of a fixing device on the opening and closing member side and unevenness of temperature occurs in the fixing device.

SUMMARY OF THE INVENTION

The present invention has been devised in view of the above-mentioned drawbacks, and it is an object of the present invention to provide an image forming apparatus that prevents unevenness of temperature in fixing means while controlling increase of temperature in an apparatus main body.

Another object of the present invention is to provide an image forming apparatus comprising: fixing means for heat-fixing an unfixed image on a recording material; a shutter movable to a first position for covering the fixing means and a second position retracting from the first position; and an opening and closing member that is openable and closable with respect to an image forming apparatus main body, in which: the shutter has a plurality of holes; when the opening and closing member is open, the shutter exists at the first position and, when the opening and closing member is closed, the shutter exists at the second position; and a size of the hole on the opening and closing member side of the shutter is smaller than a size of the hole on the opposite side of the opening and closing member.

Still another object of the present invention is to provide an image forming apparatus comprising: fixing means for heat-fixing an unfixed image on a recording material; a shutter movable to a first position for covering the fixing means and a second position retracting from the first position; and an opening and closing member that is openable and closable with respect to an image forming apparatus main body, in which: the shutter has a plurality of holes; when the opening and closing member is open, the shutter exists at the first position and, when the opening and closing member is closed, the shutter exists at the second position; and an interval of the holes on the opening and closing member side of the shutter is larger than an interval of the holes on the opposite side of the opening and closing member.

Still another object of the present invention is to provide an image forming apparatus comprising: fixing means for heat-fixing an unfixed image on a recording material; a shutter movable to a first position for covering the fixing means and a second position retracting from the first position; and an opening and closing member that is openable and closable with respect to an image forming apparatus main body, in which: the shutter has a plurality of holes; when the opening and closing member is open, the shutter exists at the first position and, when the opening and closing member is closed, the shutter exists at the second position; and the holes of the shutter are provided on the opposite side of the opening and closing member side in the shutter.

Still another object of the present invention is to provide an image forming apparatus comprising: fixing means for heat-fixing an unfixed image on a recording material; a shutter movable to a first position for covering the fixing means and a second position retracting from the first position; and an opening and closing member that is openable and closable with respect to an image forming apparatus main body, in which: the shutter has a plurality of holes; when the opening and closing member is open, the shutter exists at the first position and, when the opening and closing member is closed, the shutter exists at the second position; and the hole of the shutter is rectangular.

DESCRIPTION OF THE PREFERRED EMBODIMENTS

Embodiments of the present invention will be hereinafter described with reference to the accompanying drawings.

Figure 1:
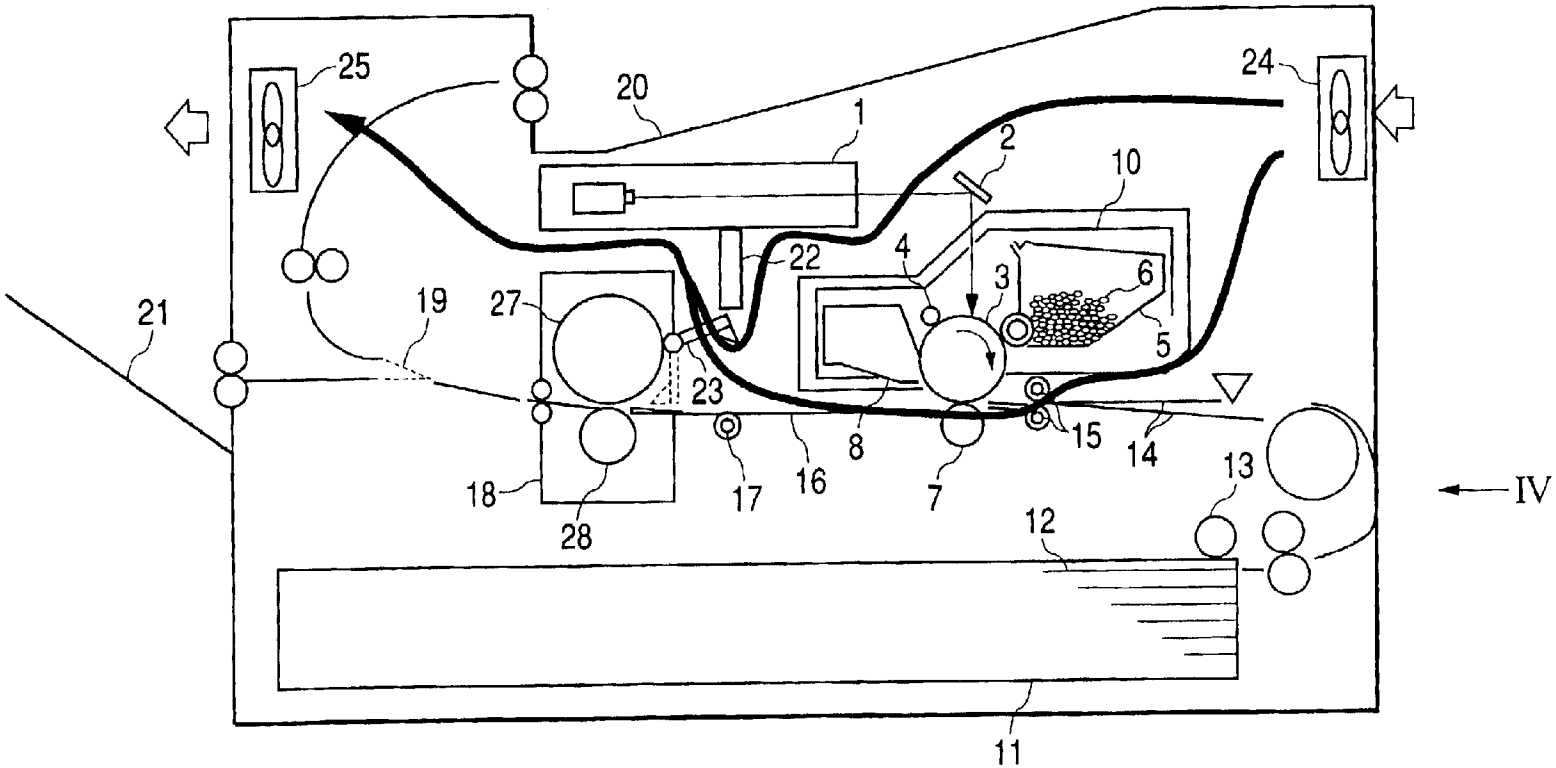
FIG. 1 is a sectional view of an image forming apparatus provided with a fixing device that is an embodiment of the present invention.
Figure 2:
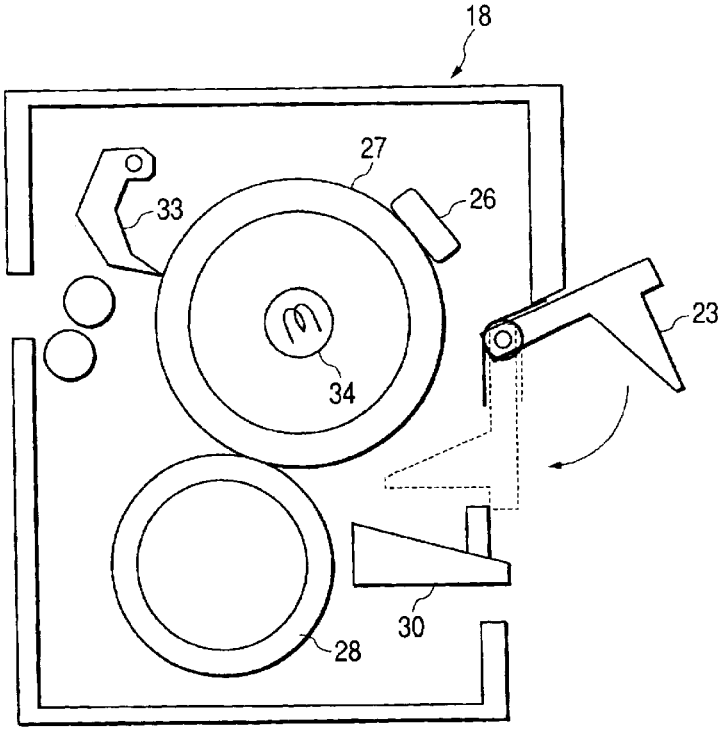
FIG. 2 is a view showing the fixing device.
Figure 3:
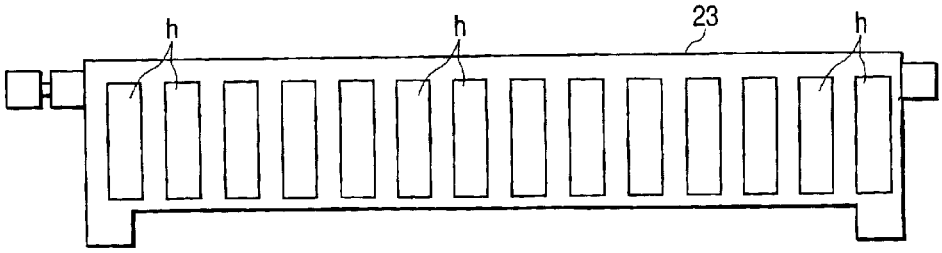
FIG. 3 is a front view of a fixing inlet shutter in accordance with the embodiment of the present invention.

FIG. 1 is a sectional view of an image forming apparatus provided with a fixing device in accordance with an embodiment of the present invention. FIG. 2 is a sectional view of the fixing device. FIG. 3 is a front view of a fixing inlet shutter.

In FIG. 1, reference numeral 1 denotes a scanner unit having optical means for irradiating a laser beam, which is emitted according to image information, and scanning means for scanning and 10 denotes a process cartridge incorporating main image forming means. A photosensitive drum 3 functioning as an image bearing member, a roller charger 4 made of semiconductive rubber, a developing device 5 for carrying toner 6 onto the photosensitive drum 3 to develop an electrostatic latent image thereon and a cleaner 8 for removing waste toner from the photosensitive drum 3 are integrally incorporated in and constitute the process cartridge 10.

With the above-mentioned configuration, the photosensitive drum 3 in the process cartridge 10 is driven to rotate and the surface of the photosensitive drum 3 is uniformly charged by the roller charger 4. Subsequently, a laser beam emitted by the scanner unit 1 is irradiated on the photosensitive drum 3 via a mirror 2, whereby an electrostatic latent image is formed on the surface of the photosensitive drum 3. Then, toner is supplied to the surface of the photosensitive drum 3 to visualize the electrostatic latent image as a toner image by the developing device 5.

On the other hand, transferring materials (basis weight 64 to 216 g) 12 that are recording materials in a sheet feeding cassette 11 are separated piece by piece and supplied by a sheet feeding roller 13. The supplied transferring material 12 is conveyed to a pair of registration rollers 15 along upper and lower guides 14. The registration rollers 15 do not move until the transferring material 12 is supplied to them. When the transferring material 12 is supplied, its leading edge collides with the registration rollers 15, whereby skew feeding of the transferring material 12 is corrected.

Subsequently, the registration rollers 15 convey the transferring material 12 to a transferring portion in such a manner as to synchronize the end of the toner image formed on the photosensitive drum 3 with the leading edge of the transferring material 12. Further, a not-shown sheet feeding sensor is disposed in the vicinity of the registration rollers 15. The sheet feeding sensor senses a sheet passing state or jam and the length of the transferring material 12.

The transferring material 12 conveyed to the transferring portion as described above is applied a charge having a polarity opposite that of the toner by a transfer roller 7 from its back. As a result, the toner image formed on the photosensitive drum 3 is transferred to the transferring material 12. The transferring material 12 with the toner image transferred thereon is conveyed to a fixing device 18 by a conveying roller 17 and a conveying guide 16. The fixing device 18 fixes an unfixed toner image on the transferring material 12 by heat and pressure to form a recorded image thereon. Then, after the image is fixed, a conveying route is selected by a flapper 19 for the transferring material 12, which is discharged to a discharge tray 20 or 21.

Next, details of the fixing device 18 will be described with reference to FIG. 2.

FIG. 2 is a sectional view showing a schematic configuration of the fixing device 18. The fixing device 18 is provided with a fixing roller 27 as a fixing member that functions as fixing means, a pressurizing roller 28 as a pressurizing member, a heater (halogen lamp) 34 that functions as heating means for a fixing member as a heating source, a temperature control thermistor 26 for sensing a temperature of the fixing roller 27, a separation claw 33 that functions as separating means of the fixing roller 27 and a fixing inlet guide 30. Further, in the illustrated example, the temperature control thermistor 26 is set in a non-image area.

The fixing device 18 employs a central reference for conveying the transferring material 12, which has a width of A3 sheet (297 mm) as a maximum sheet passing size, with a sheet passing center of the device as a reference. The fixing device 18 of this type opens a fixing inlet shutter 23 as shown by solid lines to secure a conveying path when a transferring material is conveyed. In addition, when a transferring material is not conveyed, the fixing device 18 closes the fixing inlet shutter 23 as shown by broken lines to protect a user at the time of jam treatment.

As shown in FIG. 1, in this embodiment, an intake fan 24 and an exhaust fan 25 for preventing temperature in the apparatus from increasing are installed in the apparatus main body. The intake fan 24 and the exhaust fan 25 are driven to introduce the open air into the apparatus from the outside to cool each portion of the apparatus. Air that is warmed as a result of the cooling is discharged to the outside by the exhaust fan 25 to control the temperature rising in the apparatus.

In addition, a shielding plate 22 is provided inside the apparatus main body such that heat does not flow from the fixing device 18 to the process cartridge 10. When the transferring material 12 is conveyed, the fixing inlet shutter 23 is opened as shown by solid lines in FIG. 1. However, since a plurality of rectangular holes h are formed in the fixing inlet shutter 23 as shown in FIG. 3, air can pass through these holes h and thus an air path is secured as shown by arrows in FIG. 1. As a result, the temperature rising in the apparatus can be prevented. Further, the size of each hole h formed in the fixing inlet shutter 23 is 10 mm×10 mm.

Effects with respect to the temperature rising, which are realized by using the fixing inlet shutter 23 with the plurality of holes h formed therein, are as shown in Table 1.

TABLE 1

Temperature of each member according to a difference of a fixing inlet shutter (environmental temperature: 23° C.)

| Member | Temperature of each member (° C.) | |
|---|---|---|
| | This embodiment | Conventional art |
| Cleaner | 49 | 61 |
| Photosensitive drum | 45 | 56 |
| Developing device | 41 | 50 |
| Scanner unit | 48 | 52 |
| Fixing inlet shutter | 100 | 120 |
| Sheet feeding cassette | 24 | 24 |

As described above, the temperature rising in the apparatus can be prevented by forming the holes h in the fixing inlet shutter 23 even if a fan or the like is not added.

Figure 4:
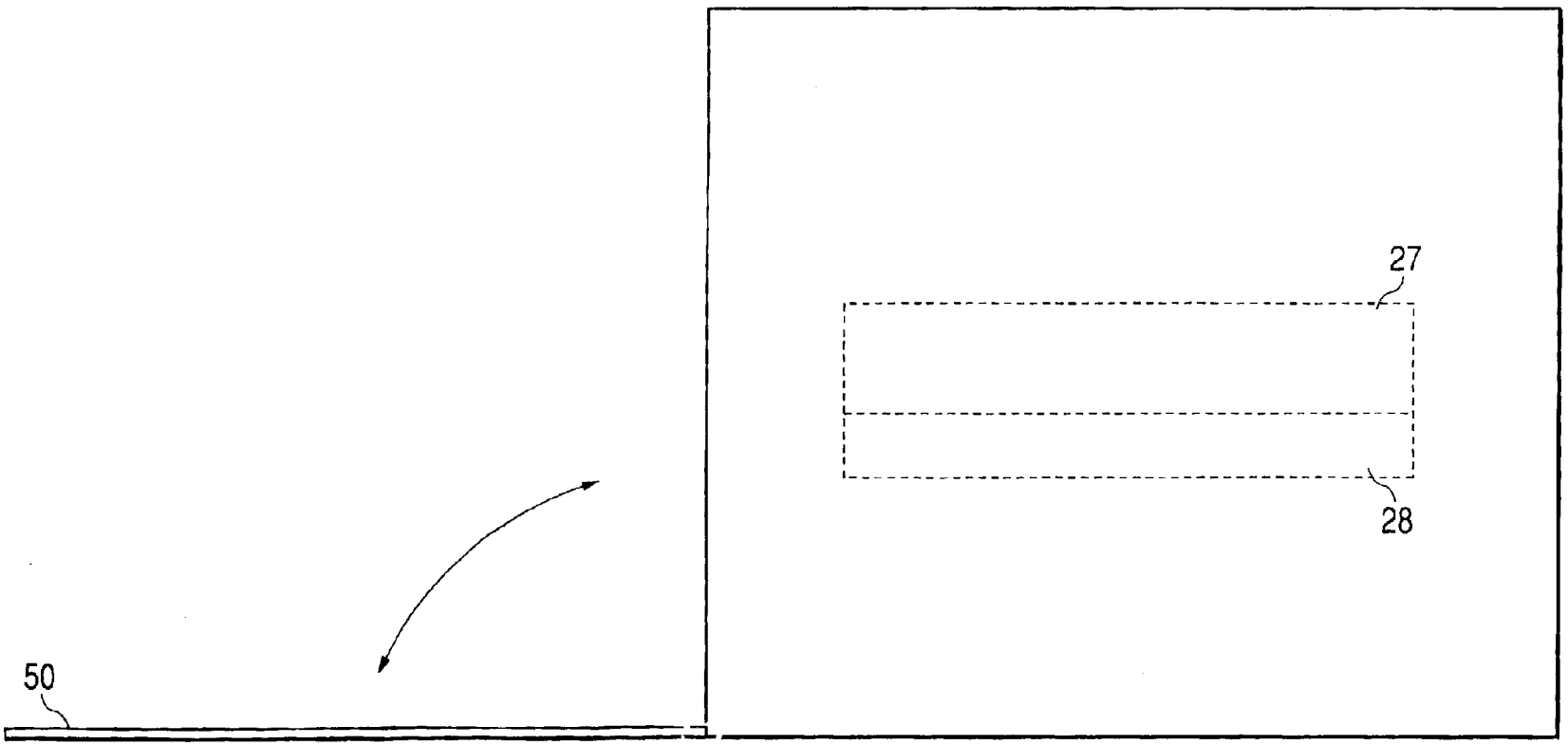
FIG. 4 illustrates the image forming apparatus of FIG. 1 viewed from an IV direction.

In addition, at the time of jam treatment or the like, the fixing inlet shutter 23 is closed as shown by broken lines in FIG. 1 associating with an opening and closing member external to the main body shown in FIG. 4. Further, FIG. 4 illustrates the image forming apparatus of FIG. 1 viewed from a direction indicated by an arrow IV. By closing the fixing inlet shutter 23 in this way, the radiation of heat of the fixing device 18 at the time of jam treatment can be prevented as much as possible to retain heat of the fixing device 18 and, at the same time, safety of a user is secured because the user does not touch a high temperature portion of the fixing device 18 in performing the jam treatment. Thus, the holes h of the fixing inlet shutter 23 should be formed in a size that does not allow a user to insert fingers (20 mm×20 mm or less).

Moreover, by closing the fixing inlet shutter 23, a jammed transferring material 12 is prevented from winding around the fixing roller 27 even if the fixing roller 27 is rotated reversely in treating the jammed transferring material 12.

As described above, the holes h are formed in the fixing inlet shutter 23 of the fixing device 18, whereby an air path at the time of conveying the transferring material 12 can be secured and, at the same time, protection of a user at the time of jam treatment can be realized.

In addition, costs can be reduced by lightening the apparatus as a result of forming the holes h in the fixing inlet shutter 23.

Further, the similar effects can be realized even if circle or any other shapes are employed as the shape of the holes h. However, as in this embodiment, if the shape of the holes h formed in the fixing inlet shutter 23 is rectangular, positions where the holes are opened and positions where the holes are not opened in the longitudinal direction of the fixing inlet shutter can be made uniformed over its latitudinal direction and adjustment of the positions of the holes can be easily performed. Thus, the holes are more preferably rectangular.

Next, another embodiment of the present invention will be described.

This embodiment is characterized by forming holes in a fixing inlet shutter functioning as transferring material shielding means of a fixing device and setting sizes of the holes in three stages, thereby realizing securing of an air path of an image forming apparatus main body and thermal insulation of the fixing device as well as protection of a user.

Configurations of the image forming apparatus and the fixing device in accordance with this embodiment are similar to those shown in FIG. 1. An opening and closing member 50 of the apparatus main body is provided in the front side of FIG. 1. Consequently, when the opening and closing member 50 is opened for jam treatment or the like, the front side of a fixing device 18 is exposed to the open air and deprived of heat.

Figure 5:
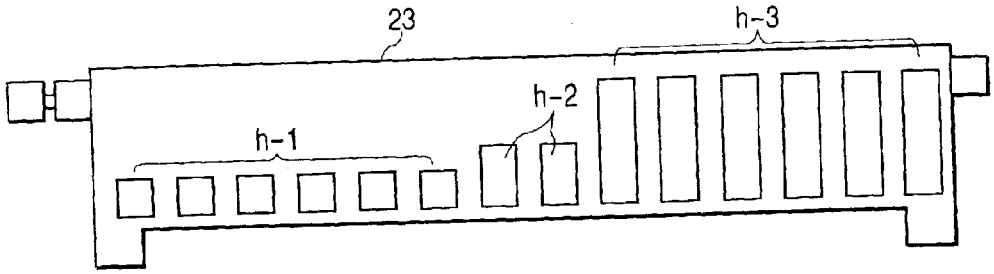
FIG. 5 is a front view of a fixing inlet shutter in accordance with another embodiment of the present invention.

Thus, three types of holes h-1, h-2 and h-3 of different sizes are formed in a fixing inlet shutter 23 as shown in FIG. 5. The holes h-1 are on the opening and closing member side. The holes closer to the opening and closing member side are smaller than those on the other side. The purpose of forming the holes h-1, h-2 and h-3 in the fixing inlet shutter 23 in this way is to secure an air path as in the above-mentioned embodiment.

The sizes of the holes h-1, h-2 and h-3 of the fixing inlet shutter 23 in this embodiment are as described below.

That is, the size of the holes h-1 on the opening and closing member side of the main body (i.e., the front side where heat of the fixing device 18 tends to be deprived at the time of jam treatment) is 5 mm×5 mm. The size of the holes h-2 in the central part is 5 mm×10 mm. The size of the holes h-3 on the opposite side of the opening and closing member is 5 mm×15 mm. The three types of holes h-1, h-2 and h-3 having the different sizes in this way are formed, whereby unevenness of temperature in the longitudinal direction of the fixing device due to radiation of heat of the fixing device 18 at the time of jam treatment or the like can be prevented.

Operations of the fixing inlet shutter 23 are similar to those of the above-mentioned embodiment. That is, the fixing inlet shutter 23 is opened as shown by solid lines in FIG. 1 at the time of conveying a transferring material, or the like, to secure an air path at the time of conveying a transferring material and a conveying path of the transferring material 12, thereby preventing temperature rising in the apparatus. In addition, at the time of jam treatment or the like, the fixing inlet shutter 23 is closed as shown by broken lines of FIG. 1, whereby radiation of heat of the fixing device 18 and protection of a user are realized. Further, for the protection of a user, the long side of the largest hole h-3 shall be 20 mm or less.

Moreover, the transferring material 12 never winds around the fixing roller 27 even if the fixing roller 27 is reversely rotated at the time of jam treatment.

Figure 6:
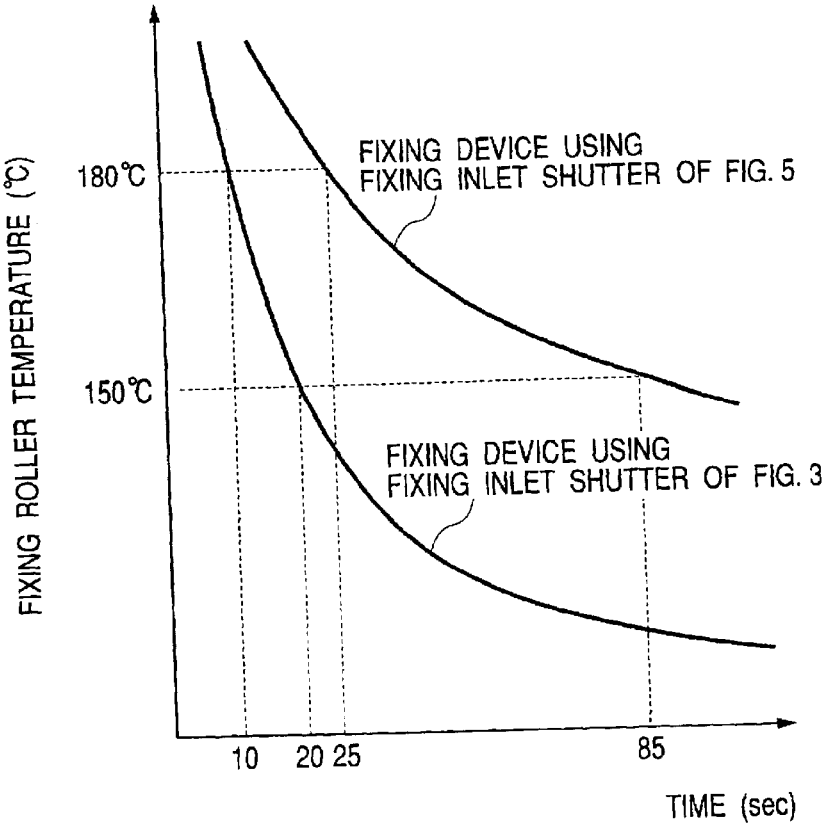
FIG. 6 is a graph showing changes over time in temperature of a fixing roller.

Here, changes in temperature of the fixing roller 27 at the time of jam treatment or the like are shown in FIG. 6.

As shown in FIG. 6, the fixing device 18 using the fixing inlet shutter 23 in accordance with this embodiment with the holes h-1 on the front side, where the opening and closing member 50 is located, formed smaller has a high thermal insulation effect. Thus, the fall of temperature of the fixing roller 27 is gentle compared with that of the fixing roller 27 of the fixing device 18 in accordance with the above-mentioned embodiment. Consequently, according to this embodiment, energy can be saved and an activation time of the fixing device 18 after jam treatment becomes shorter. In addition, since the holes h-1 are on the front side where the opening and closing member 50 is located, unevenness of temperature in the longitudinal direction of the fixing device can be prevented.

As described above, in the case in which the opening and closing member of the main body is located on the front side, the holes h-2 in the center are made larger than the holes h-1 on the opening and closing member side of the main body and the holes h-3 on the inner side are made larger than the holes h-2 in the center among the holes h-1, h-2 and h-3 of the fixing inlet shutter 23 to set their sizes in three stages. As a result, an air path at the time of conveying a transferring material can be secured and, at the same time, unevenness of temperature due to radiation of heat of the fixing device 18 at the time of jam treatment can be prevented. Moreover, protection of a user can be realized.

Incidentally, the shape of the holes h-1 to h-3 formed in the fixing inlet shutter 23 is described as rectangular in this embodiment. However, it is needless to mention that the same effects can be realized even if circle or any other shapes are employed as the shape of the holes h-1 to h-3.

Next, another embodiment of the present invention will be described.

This embodiment is characterized by setting sizes of holes, which are formed on a fixing inlet shutter functioning as transferring material shielding means of a fixing device, in a plurality of stages that is more than three stages, thereby realizing both securing of an air path of an image forming apparatus main body as well as prevention of radiation of heat of the fixing device and protection of a user.

Configurations of the image forming apparatus and the fixing device in accordance with this embodiment are similar to those shown in FIG. 1. A fixing inlet shutter 23 used in this embodiment is shown in FIG. 7.

Figure 7:
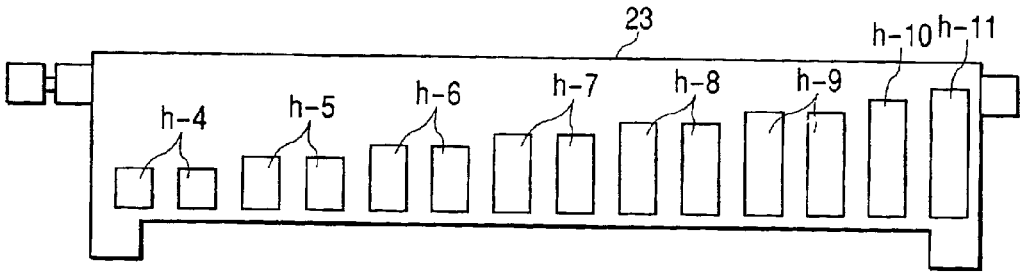
FIG. 7 is a front view of a fixing inlet shutter in accordance with another embodiment of the present invention.

As shown in FIG. 7, in this embodiment, a plurality of holes h-4 to h-11 of different sizes are formed in the fixing shutter 23 of a fixing device 18, and the holes h-4 to h-11 are arranged to be larger in order from the opening and closing member side of the main body to the longitudinal direction of the fixing shutter 23. The size of each hole h-4 to h-11 is as shown in Table 2. Further, hole numbers h-4, h-5, . . . , h-11 are given in order from the opening and closing member side of the main body (i.e., the front side of the fixing device 18 where heat tends to be deprived).

TABLE 2

| Hole number | Hole size (mm) Width | Hole size (mm) Length |
|---|---|---|
| h-4 | 5 | 5 |
| h-5 | 5 | 6 |
| h-6 | 5 | 7 |
| h-7 | 5 | 8 |
| h-8 | 5 | 9 |
| h-9 | 5 | 10 |
| h-10 | 5 | 11 |

With such a configuration of the fixing inlet shutter 23, an air path of the main body can be secured. In addition, unevenness of temperature due to radiation of heat of the fixing device 18 can be prevented and protection of a user can be realized by making the holes h-4 small which is on the opening and closing member side where heat tends to be deprived at the time of jam treatment or the like.

As described above, since the holes h-4 to h-11 of the fixing inlet shutter 23 of the fixing device 18 are arranged to be larger in order from the front side, an air path at the time of conveying a transferring material can be secured and, at the same time, radiation of heat on the front side of the fixing device 18 at the time of jam treatment can be prevented. As a result, unevenness of temperature can be prevented and protection of a user can be realized.

Further, the shape of the holes h-4 to h-11 formed in the fixing inlet shutter 23 is described as rectangular in this embodiment. However, it is needless to mention that the same effects can be realized even if circle or any other shapes are employed as the shape of the holes h-4 to h-11.

Next, another embodiment of the present invention will be described.

This embodiment is characterized by setting intervals of holes, which are formed on a fixing inlet shutter functioning as transferring material shielding means of a fixing device, to be smaller in order from an opening and closing member side of an image forming apparatus main body, thereby realizing both securing of an air path of the main body as well as prevention of radiation of heat of the fixing device and protection of a user.

Configurations of an image forming apparatus and the fixing device in accordance with this embodiment are similar to those shown in FIG. 1. A fixing inlet shutter 23 used in this embodiment is shown in FIG. 8.

Figure 8:
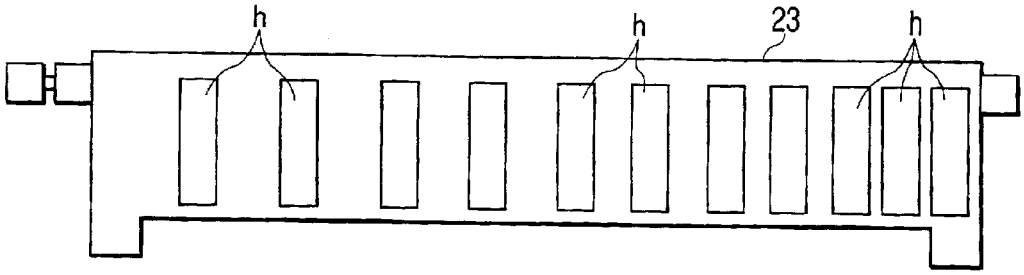
FIG. 8 is a front view of a fixing inlet shutter in accordance with another embodiment of the present invention.

As shown in FIG. 8, intervals of holes h formed in the fixing inlet shutter 23 of the fixing device 18 in this embodiment are set to be smaller in order from the opening and closing member side of the main body to the longitudinal direction of the fixing inlet shutter 23. The size of each hole h is uniform and set at 5 mm×15 mm. The intervals of the holes h are gradually getting smaller in order from the opening and closing member side of the main body as 35 mm, 32 mm, . . . , 2 mm.

While securing an air path of the main body by configuring the fixing inlet shutter 23 as described above, radiation of heat on the front side of the fixing device 18 can be prevented and protection of a user can also be realized by expanding the interval of the holes h on the opening and closing member side where heat tends to be deprived at the time of jam treatment or the like.

As described above, the intervals of the holes h formed in the fixing inlet shutter 23 of the fixing device 18 are set to be smaller in order from the front side and are set in a plurality of stages, whereby an air path at the time of conveying a transferring material can be secured and, at the same time, unevenness of temperature due to radiation of heat of the fixing device 18 at the time of jam treatment can be prevented and protection of a user can be further realized.

Further, the shape of the holes h formed in the fixing inlet shutter 23 is described as rectangular in this embodiment. However, it is needless to mention that the same effects can be realized even if circle or any other shapes are employed as the shape of the holes h.

Next, another embodiment of the present invention will be described.

This embodiment is characterized by associating positions of holes formed in a fixing inlet shutter functioning as a transfer member shielding means of a fixing device with an opening and closing member of an image forming apparatus main body installed in the upper part of the apparatus, thereby realizing both securing of an air path of the main body as well as prevention of radiation of heat of the fixing device and protection of a user.

Figure 9:
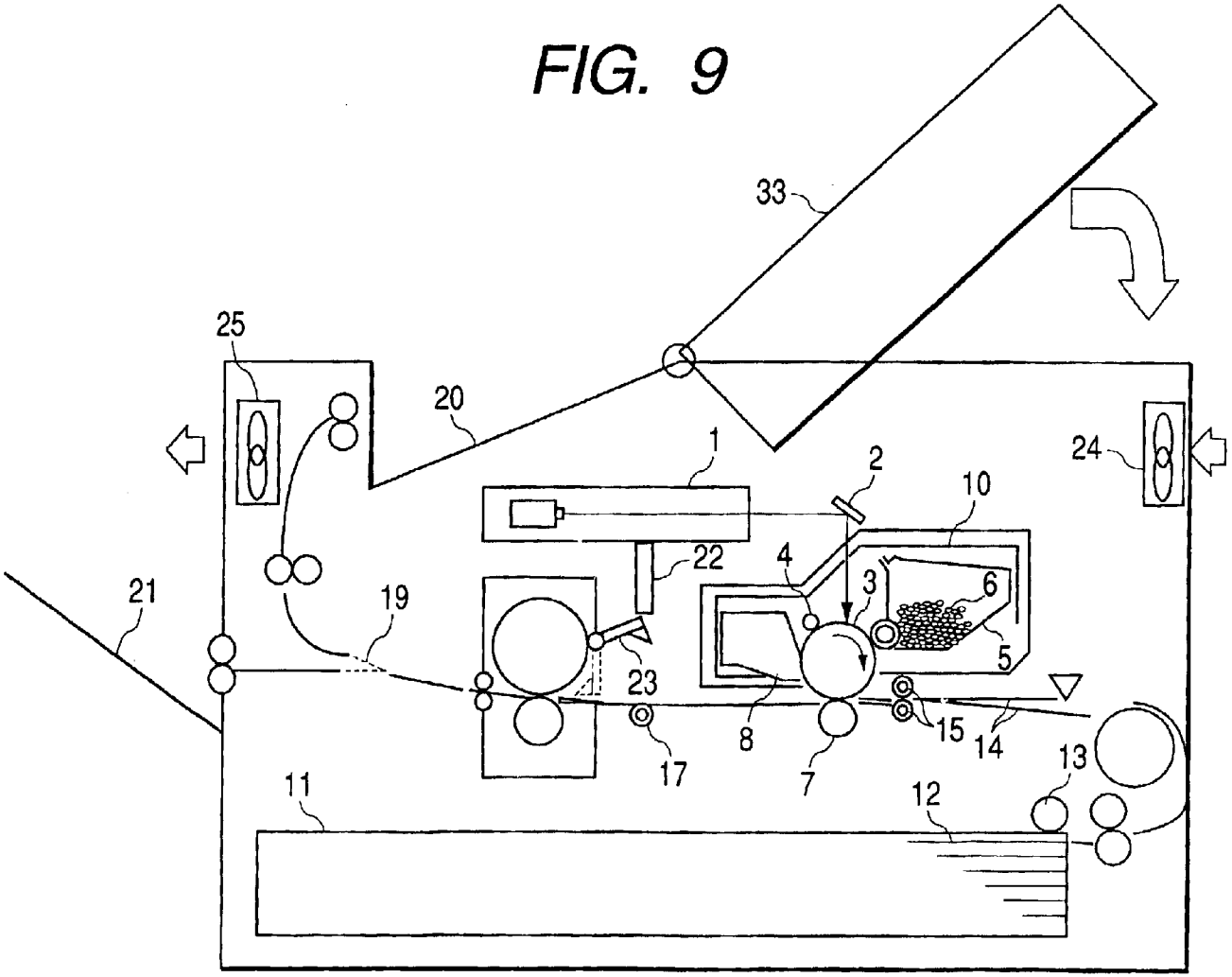
FIG. 9 is a sectional view of an image forming apparatus provided with a fixing device that is another embodiment of the present invention.

Configurations of an image forming apparatus and the fixing device in accordance with this embodiment are similar to those shown in FIG. 1. The image forming apparatus and a fixing inlet shutter 23 used in this embodiment are shown in FIG. 9 and FIG. 10, respectively.

Figure 10:
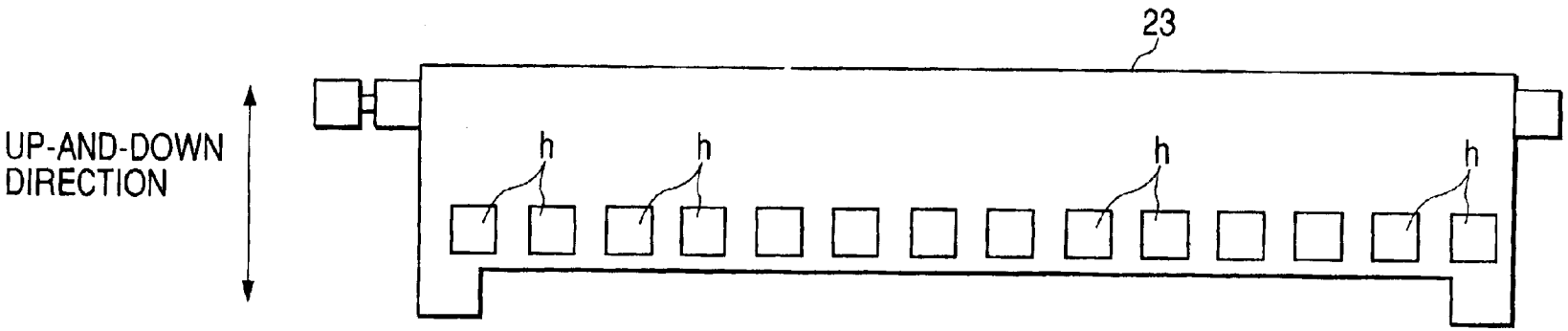
FIG. 10 is a front view of a fixing inlet shutter in accordance with another embodiment of the present invention.
Figure 11:
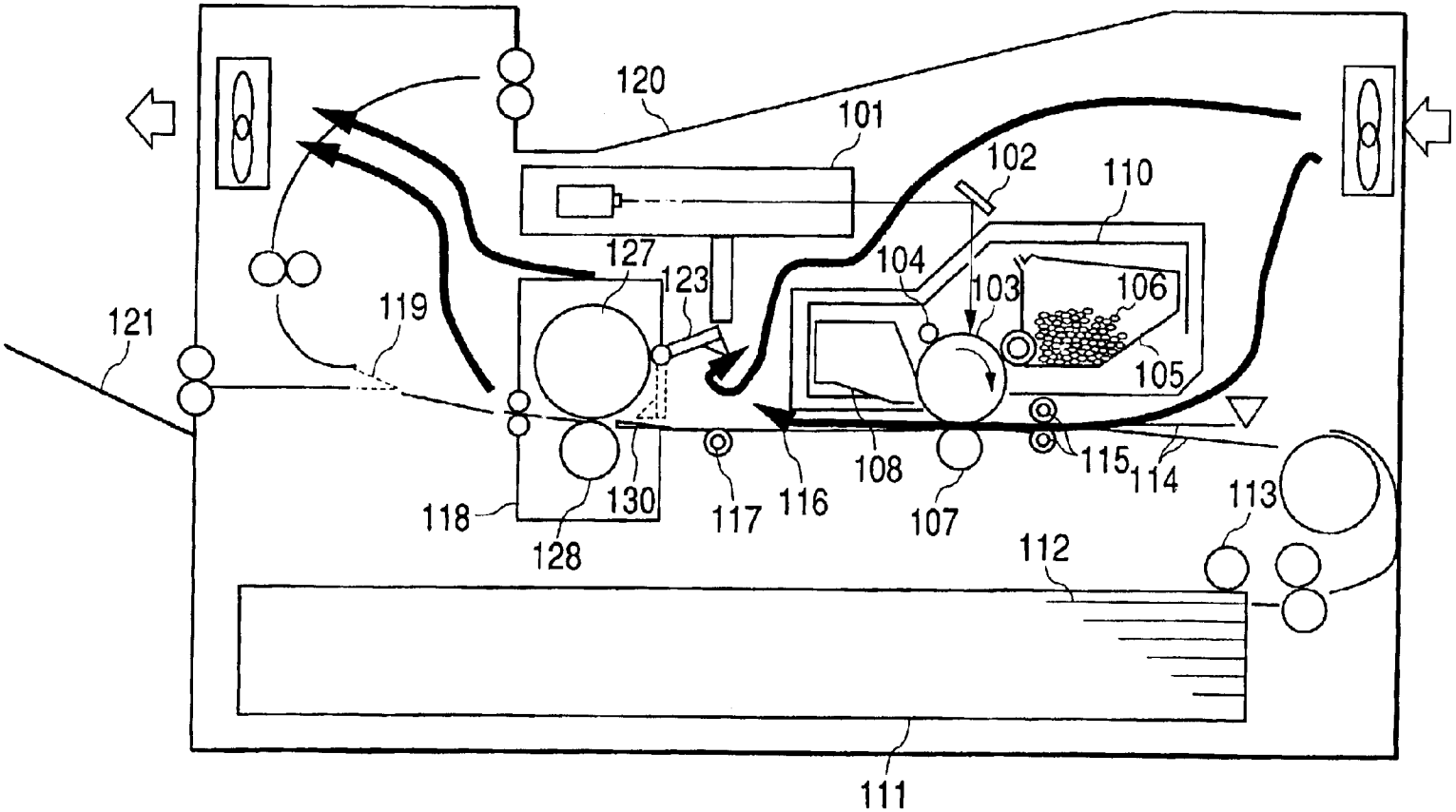
FIG. 11 is a sectional view of an image forming apparatus provided with a conventional fixing device.

As shown in FIG. 10, a plurality of square holes h are formed in parts lower than the center of the fixing inlet shutter 23. This is because a position where an opening and closing member 33 of the main body shown in FIG. 9 is installed is located in the upper part of the main body. Since the opening and closing member 33 of the main body is located in the upper part of the main body, heat of the fixing device 18 is radiated from the upper part at the time of jam treatment or the like. Consequently, the holes h are formed in the lower part of the fixing inlet shutter 23 in this embodiment. Further, the size of each hole h is 5 mm×5 mm.

As described above, according to this embodiment, since the plurality of holes h are formed in the part lower than the center of the fixing inlet shutter 23 of the fixing device 18 in association with the position of the opening and closing member 33 of the main body, an air path at the time of conveying a transferring material can be secured and, at the same time, unevenness of temperature in the up-and-down direction (direction perpendicular to the longitudinal direction) of the fixing device due to radiation of heat of the fixing device 18 at the time of jam treatment can be prevented and protection of a user can be realized.

Further, the shape of the holes h formed in the fixing inlet shutter 23 is described as square in this embodiment. However, it is needless to mention that the same effects can be realized even if circle or any other shapes are employed as the shape of the holes h.

As is evident from the above description, according to the present invention, there is provided a fixing device that is provided in an image forming apparatus having an opening and closing member for accessing the inside of the image forming apparatus, has fixing means to be heated by heating means and pressurizing means to be brought to be in pressed contact with the fixing means and passes a transferring material having a toner image transferred thereon through a pressed contact portion between the rotatable fixing means and the pressurizing means to fix the toner image on the transferring material, in which a fixing inlet shutter that rotates associating with opening and closing of the opening and closing member is provided on a transferring material delivery side of the fixing means and holes are formed in the fixing inlet shutter. Therefore, securing of an air path at the time of conveying a transferring material as well as prevention of radiation of heat and protection of a user at the time of jam treatment can be realized without causing increase of costs and, in addition, unevenness of temperature of the fixing device can be prevented by regulating the size of the holes, the interval of the holes or the position of the holes.

That is, according to the present invention, since the holes are formed in the fixing inlet shutter, an air path at the time of conveying a transferring material can be secured in the image forming apparatus main body and temperature rising in the apparatus can be prevented without adding a fan or the like. Thus, increase of costs is not caused.

In addition, at the time of jam treatment or the like, if the fixing inlet shutter is closed associating with the opening and closing member, radiation of heat of the fixing device at the time of jam treatment can be prevented to retain heat of the fixing device and, at the same time, a user can be protected because the user does not touch a high temperature portion of the fixing device in performing jam treatment. Further, in the jam processing, unevenness of temperature of the fixing device can be prevented by regulating the size of the holes, the interval of the holes or the position of the holes.

While the embodiments of the invention has been described, the invention is not confined to the embodiments and the invention is intended to cover such modifications or changes as may come within the technical idea of the invention.

What is claimed is:

1. An image forming apparatus comprising:

fixing means for heat-fixing an unfixed image on a recording material;

a shutter movable to a first position for covering said fixing means and a second position retracting from said first position, said shutter having a plurality of holes; and an opening and closing member that is openable and closable with respect to an image forming apparatus main body;

wherein, when said opening and closing member is open, said shutter exists at said first position and, when said opening and closing member is closed, said shutter exists at said second position, and wherein a size of said hole on said opening and closing member side of said shutter is smaller than a size of said hole on an opposite side of said opening and closing member.

2. An image forming apparatus according to claim 1, wherein said shutter exists on a recording material inlet side of said fixing means.

3. An image forming apparatus according to claim 1, wherein said first position is a position of a conveying path of a recording material and said second position is a position deviating from the conveying path of the recording material.

4. An image forming apparatus according to claim 1, wherein said hole forms a part of an air path in the image forming apparatus main body when said shutter exists at said second position.

5. An image forming apparatus comprising:

fixing means for heat-fixing an unfixed image on a recording material;

a shutter movable to a first position for covering said fixing means and a second position retracting from said first position, said shutter having a plurality of holes; and an opening and closing member that is openable and closable with respect to an image forming apparatus main body;

wherein, when said opening and closing member is open, said shutter exists at said first position and, when said opening and closing member is closed, said shutter exists at said second position, and wherein an interval of said holes on said opening and closing member side of said shutter is larger than an interval of said holes on an opposite side of said opening and closing member.

6. An image forming apparatus according to claim 5, wherein said shutter exists on a recording member inlet side of said fixing means.

7. An image forming apparatus according to claim 5, wherein said first position is a position of a conveying path of a recording material and said second position is a position deviating from the conveying path of the recording material.

8. An image forming apparatus according to claim 5, wherein said hole forms a part of an air path in the image forming apparatus main body when said shutter exists in said second position.

9. An image forming apparatus comprising:

fixing means for heat-fixing an unfixed image on a recording material;

a shutter movable to a first position for covering said fixing means and a second position retracting from said first position, said shutter having a plurality of holes; and an opening and closing member that is openable and closable with respect to an image forming apparatus main body;

wherein, when said opening and closing member is open, said shutter exists at said first position and, when said opening and closing member is closed, said shutter exists at said second position, wherein said holes of said shutter are provided on an opposite side of said opening and closing member side in said shutter, and wherein said first position is a position of a conveying path of a recording material and said second position is a position deviating from the conveying path of the recording material.

10. An image forming apparatus according to claim 9, wherein said shutter exists on a recording material inlet side of said fixing means.

11. An image forming apparatus according to claim 9, wherein said hole forms a part of an air path in the image forming apparatus main body when said shutter exists at said second position.

12. An image forming apparatus comprising:

fixing means for heat-fixing an unfixed image on a recording material;

a shutter movable to a first position for covering said fixing means and a second position retracting from said first position, said shutter having a plurality of holes; and an opening and closing member that is openable and closable with respect to an image forming apparatus main body;

wherein, when said opening and closing member is open, said shutter exists at said first position and, when said opening and closing member is closed, said shutter exists at said second position, wherein said hole of said shutter is rectangular, and wherein said first position is a position of a conveying path of a recording material and said second position is a position deviating from the conveying path of the recording material.

13. An image forming apparatus according to claim 12, wherein said shutter exists on a recording material inlet side of said fixing means.

14. An image forming apparatus according to claim 12, wherein said hole forms a part of an air path in the image forming apparatus main body when said shutter exists at said second position.

* * * * *

UNITED STATES PATENT AND TRADEMARK OFFICE

CERTIFICATE OF CORRECTION

PATENT NO. : 6,754,458 B2
DATED : June 22, 2004
INVENTOR(S) : Tomoyuki Makihira

It is certified that error appears in the above-identified patent and that said Letters Patent is hereby corrected as shown below:

Column 8,
Line 28, “is” should read -- are --.

Column 9,
Line 48, “are” should read -- is --.

Column 10,
Line 34, “has” should read -- have --.

Signed and Sealed this

Sixteenth Day of November, 2004

JON W. DUDAS
*Director of the United States Patent and Trademark Office*